US006038330A

United States Patent [19]

Meucci, Jr.

[11] Patent Number: 6,038,330

[45] Date of Patent: Mar. 14, 2000

[54] VIRTUAL SOUND HEADSET AND METHOD FOR SIMULATING SPATIAL SOUND

[76] Inventor: Robert James Meucci, Jr., 1909 Cypress Corner Rd., Senatobia, Miss. 38668

[21] Appl. No.: 09/026,604

[22] Filed: Feb. 20, 1998

[51] Int. Cl.[7] ..... H04R 25/00

[52] U.S. Cl. ..... 381/371; 345/8; 348/53

[58] Field of Search ..... 381/370, 371, 381/376, 309, 310; 345/8; 348/53

[56] References Cited

U.S. PATENT DOCUMENTS

| | | | |
|---|---|---|---|
| 224,073 | 2/1880 | Cary . | |
| 3,676,594 | 7/1972 | Shore | 179/1 VL |
| 3,794,779 | 2/1974 | Greuzerd et al. | 179/156 R |
| 3,796,840 | 3/1974 | Ohta | 179/156 R |
| 3,836,724 | 9/1974 | Yamazaki | 179/182 R |
| 3,939,310 | 2/1976 | Hodges | 179/156 R |
| 3,984,885 | 10/1976 | Yoshimura et al. | 179/156 R |
| 4,005,278 | 1/1977 | Gorike | 179/181 R |
| 4,087,631 | 5/1978 | Yamada et al. | 179/1 G |
| 4,097,689 | 6/1978 | Yamada et al. | 179/1 G |
| 4,136,260 | 1/1979 | Asahi | 179/1 G |
| 4,251,686 | 2/1981 | Sokolich | 179/1 N |
| 4,412,106 | 10/1983 | Pavel | 179/156 R |
| 4,433,209 | 2/1984 | Kurosawa et al. | 381/1 |
| 4,443,668 | 4/1984 | Warren | 179/156 A |
| 4,748,669 | 5/1988 | Klayman | 381/1 |
| 4,789,044 | 12/1988 | Akino | 181/158 |
| 4,817,149 | 3/1989 | Myers | 381/1 |
| 4,821,323 | 4/1989 | Papiernik | 381/25 |
| 4,829,571 | 5/1989 | Kakiuchi et al. | 381/25 |
| 4,965,836 | 10/1990 | Andre et al. | 381/183 |
| 5,137,110 | 8/1992 | Bedard, Jr. et al. | 181/153 |
| 5,148,887 | 9/1992 | Murphy | 181/129 |
| 5,175,768 | 12/1992 | Daniels | 381/25 |
| 5,201,003 | 4/1993 | Pavel | 381/25 |
| 5,272,757 | 12/1993 | Scofield et al. | 381/25 |
| 5,307,415 | 4/1994 | Fosgate | 381/22 |
| 5,333,206 | 7/1994 | Koss | 381/183 |
| 5,337,363 | 8/1994 | Platt | 381/17 |
| 5,345,512 | 9/1994 | Lee | 381/183 |
| 5,357,277 | 10/1994 | Nakayoshi et al. | 348/55 |
| 5,371,799 | 12/1994 | Lowe et al. | 381/25 |
| 5,434,924 | 7/1995 | Jampolsky | 381/68.4 |
| 5,438,623 | 8/1995 | Begault | 381/17 |
| 5,459,790 | 10/1995 | Scofield et al. | 381/25 |
| 5,467,401 | 11/1995 | Nagamitsu et al. | 381/63 |
| 5,474,290 | 12/1995 | Rascona et al. | 273/55 R |
| 5,521,981 | 5/1996 | Gehring | 381/17 |
| 5,521,982 | 5/1996 | Schiftan | 381/25 |
| 5,524,053 | 6/1996 | Iwamatsu | 381/18 |
| 5,533,137 | 7/1996 | Holmes | 381/183 |
| 5,544,249 | 8/1996 | Opitz | 381/63 |
| 5,546,227 | 8/1996 | Yasugaki et al. | 359/630 |
| 5,682,172 | 10/1997 | Travers et al. | 345/8 |
| 5,684,879 | 11/1997 | Verdick | 381/370 |
| 5,706,360 | 1/1998 | Khandekar | 381/183 |

*Primary Examiner*—Curtis A. Kuntz
*Assistant Examiner*—Dionne N. Harvey

[57] ABSTRACT

A virtual sound headset and method are provided for simulating spatial sound. The headset includes left and right headphones interconnected by a headband. Each of the headphones includes a hollow casing forming an interior chamber having an opening effective for receiving one of the listener's ears and a plurality of sound focusing assemblies mounted on the casing, with the assemblies being spaced apart from one another and in acoustic communication with the corresponding interior chamber. Each sound focusing assembly includes an electroacoustic transducer effective for reproducing sound in response to an electric input signal and a mechanical-acoustic means for mounting the electroacoustic transducer on the casing and for focusing the sound emanating from the transducer so as to simulate the directional orientation of the sound as perceived by the listener. The focused or directionalized sound is directed toward the pinna of the corresponding ear to allow spectral modification to occur.

17 Claims, 5 Drawing Sheets

VIRTUAL SOUND HEADSET AND METHOD FOR SIMULATING SPATIAL SOUND

BACKGROUND OF THE INVENTION 1.0 Field of the Invention

The present invention relates generally to headsets for sound reproduction and, more particularly, to a headset which reproduces sound in a manner which enhances the spatial or three-dimensional quality of the sound as perceived by the listener.

2.0 Related Art

Headsets have been in widespread use for some time for the purpose of providing personal musical entertainment. More recently, headsets have been used as an integral part of a variety of interactive video systems. Headsets include a pair of headphones, with one cupped over each ear of the listener, and a headband which separates and is attached to the headphones. Each headphone includes at least one acoustic transducer for the purpose of reproducing sound.

Human hearing is spatial and 3-dimensional in nature, i.e., a listener with normal hearing his aware of the spatial location of objects which produce sounds in his environment. Natural spatial hearing, which is also referred to as binaural hearing, permits a person to identify the locations of a variety of sound sources, such as musical instruments or voices, occurring simultaneously and to discern the location and direction of movement of moving objects such as motor vehicles.

As sound reproduction systems have advanced from early monaural systems to stereophonic and later quadrophonic systems, those skilled in the acoustic arts have applied a variety of sound enhancement technologies to headphones to improve the listening experience. For instance, U.S. Pat. No. 4,821,323 issued to Papiernick discloses a stereo headphone having a pair of conventional speakers as well as a pair of secondary vibrational audio output discs adapted to rest against the temple of the user, to transmit sound waves through the bones and tissues of the user's head, as well as through the use's ears, to simulate a concert hall listening environment.

A common goal of many headphones has been the elimination of "in-the-head" sound of earlier headphones which produced sound lacking binaural cues and the production of sound having enhanced spatial, or 3-dimensional quality as perceived by the listener. For instance, U.S. Pat. No. 5,175,768 issued to Daniels discloses electrical circuitry and the associated methodology to provide effective simulated acoustic cross coupling in stereo headphones, noting that the lack of acoustic coupling (i.e., sound shared by both ears) results in a sound field lacking depth. Instead the sound is compressed and wedged into the central upper portion of the head. Daniels further notes that cross coupled signals have been demonstrated to aid in headphone listening, with most listeners reporting a marked sense of spatial expansion to the resultant sound field. U.S. Pat. No. 3,939,310 issued to Hodges discloses a stereophonic headset having an enclosed ear-to-ear acoustical passageway which is provided so that each of the listener's ears hear the output of both headset stereophonic speakers.

The production of multi-dimensional sound, typically referred to as 3-D or 3-dimensional sound, has become particularly desirable due to the work being done in the field entitled "Virtual Reality" which includes both 3-dimensional visual displays as well as 3-dimensional sound. For instance, with the advent of home computers and interactive visual communication systems using home television sets as a video display means, it has become increasingly desirable to generate 3-dimensional sound or sounds associated with an object or objects appearing on the television screen and further to permit the listener and viewer to make interactive decisions with the images displayed on the screen.

It is known in the acoustic arts that sounds which have binaural location cues permit a listener to locate the source of the sound in 3-dimensional space. It is further understood that these cues are created primarily by the intensity and phase (time of arrival) differences between the sound at the two ears of the listener, as well as the spectral changes of sound resulting from the complex shape of the pinnae, or outer ears. This spectral modification may also be affected by the head and torso of the listener. It is further recognized that the left-right directional sense of sound is perceived by the interaural time difference and intensity difference when the sound waves reach the head, while the primary physical cause of up-down and forward-backward directional perception is sound wave distortion, or spectral modification, caused by the pinnae. Furthermore, it is understood that the earphones of headsets disturb the conch resonance of the pinnae.

An early method of simulating the production of 3-dimensional sound recording utilized a dummy head ("kunstkoph"). With this method, two recording microphones are placed within the ears of an anthropometric mannequin, with the ears being formed to replicate human ears. Although this method may simulate the reproduction of 3-dimensional or spatial sound, any simulation of spatial sound which may occur is based upon the mannequin ears and not the ears of the listener. Accordingly, the intended simulation may be adversely affected due to the difference in the material used to construct the mannequin ears, as compared to the flesh and cartilage of the human ear, and due to any difference in the particular shape of the mannequin ears as compared to the ears of the listener. Additionally, although the original spatial location of the sound may be captured, it may not be edited or modified. Accordingly, this earlier mechanical means of binaural processing is not useful in a video game for example, where the sound must be interactively repositioned during game play.

U.S. Pat. No. 4,817,149 issued to Myers discloses a later development comprising a binaural signal processing circuit and method which is capable of processing a signal so that a localization position of the sound can be selectively moved. Elevation and front/back cues are established utilizing direction-dependent filtering while horizontal (azimuthal) localization is achieved by interaural time differences.

Recent developments in binaural processing use a digital signal processor (DSP) to mathematically emulate a dummy head process in real time but with positionable sound location. Typically, the combined effect of the head, ear and pinnae are represented by a left-right pair of head-related transfer functions (HRTFs) corresponding to spherical directions around the listener, usually described angularly as degrees of azimuth and elevation relative to the listener's head. The HRTFs may arise from laboratory measurements or may be derived by means known to those skilled in the art. Right and left ear binaural signals may then be produced by applying a mathematical process known as convolution wherein the digitized original sound is convolved in real time with the right and left HRTFs corresponding to the desired spatial location. The sound reproduced from these binaural signals, when heard, appear to originate from a desired location. A sound may be repositioned by changing the HRTFs to those for the desired new location.

Although DSP-based binaural systems are known to be effective, they are also known to be costly because the required real time convolution processing of a sound imposes a substantial computing burden. U.S. Pat. No. 5,521,981 issued to Gehring discloses alternative apparatus which eliminates the need for a DSP and real time binaural convolution processing and provides means to achieve real time, responsive binaural sound positioning. The burdensome processing task of binaural convolution required for spatial sound is performed in advance by a preprocessing means.

U.S. Pat. No. 5,438,623 issued to Begault discloses a multi-channel spatialization system for audio signals which is illustrative of another system utilizing HRTFs for producing 3-dimensional audio signals. The stated objectives of the disclosed apparatus and associated method include, but are not limited to: producing 3-dimensional audio signals which appear to come from separate and discrete positions from about the head of a listener; and to reprogrammably distribute simultaneous incoming audio signals at different locations about the head of a listener wearing headphones. Begault indicates that the stated objectives are achieved by generating synthetic HRTFs for imposing reprogrammable spatial cues to a plurality of audio input signals received simultaneously by the use of interchangeable programmable read-only memories (PROMs) which store both head related transfer function impulse response data and source positional information for a plurality of desired virtual source locations. The analog inputs of the audio signals are filtered and converted to digital signals from which synthetic head related transfer functions are generated in the form of linear phase finite impulse response filters. The outputs of the impulse response filters arc subsequently reconverted to analog signals, filtered, mixed and fed to a pair of headphones. Another aspect of the disclosed invention is to employ a simplified method for generating synthetic HRTFs so as to minimize the quantity of data necessary for HRTF generation.

Based on the foregoing, it may be seen that there is a continuing need in the acoustic arts to provide headphones which deliver 3-dimensional, or spatial sound to the ears of the listener in a simple and economical manner.

SUMMARY OF THE INVENTION

In view of the foregoing needs, the present invention is directed to a simple and cost effective virtual sound headset and method for simulating spatial, or three-dimensional sound, as perceived by the listener, which is achieved by focusing the sound emanating from each of the electroacoustic transducers included in the headset of the present invention. According to a first aspect of the present invention, a virtual sound headset is provided comprising left and right headphones interconnected by a headband, with the headset being effective for reproducing sound having a spatial, or three-dimensional quality, as perceived by the headset user.

According to a preferred embodiment, each of the left and right headphones includes a hollow casing, preferably having a substantially hemispherical shape, forming an interior chamber having an opening effective for receiving one of the listener's ears so that each of the listener's ears is disposed within one of the interior chambers when the headset is use. Each headphone further includes a plurality of sound focusing assemblies mounted on the casing, with the assemblies being spaced apart from one another and in acoustic communication with the corresponding interior chamber.

Each sound focusing assembly includes an electroacoustic transducer, preferably comprising a miniaturized hi-fidelity speaker, effective for reproducing sound in response to an electric input signal. The sound focusing assemblies further include a mechanicalacoustic means for mounting the electroacoustic transducer on the casing and for directionalizing the sound emanating from the transducer so as to permit the listener to identify the directional orientation of the sound. The mechanical-acoustic means preferably comprises an outer tube having an inner diameter sized to permit the transducer to be disposed within the tube, an inner tube coaxially disposed with and radially inward of the outer tube, and a sound-absorbing material disposed within the outer tube and surrounding a longitudinally extending portion of the inner tube.

Each outer tube has a first end attached to the casing. The transducer of each sound focusing assembly is disposed proximate the opposite end of the corresponding outer tube and includes a sound-emitting surface which is longitudinally spaced apart from a first, open end of the inner tube and from the sound-absorbing material positioned within the outer tube. The inner tube further includes an opposite, open end in acoustic communication with the interior chamber formed by the hollow casing. The inner tube is effective for transmitting sound in a substantially radial direction to a substantially central, outer portion of the corresponding ear of the listener, and is preferably made of a relatively hard material, preferably comprising polyvinyl chloride, which provides a relatively low resistance to the transmission of sound therethrough.

Each headphone includes an annular flange attached to the corresponding casing, proximate the opening of the interior chamber, and an annular seal attached to the annular flange. The annular seals are disposed in surrounding relationship with the corresponding ear of the listener and in sealing engagement with the listener's head when the headset is in use.

The headband further includes a pair of generally arcuate headphone support frames, with the frames being attached to opposite ends of the central portion of the headband and to one of the left and right headphones. The headset further includes a layer of a sound-absorbing material disposed within and attached to an inner surface of the casing and conforming generally to the shape of the casing. The inner tube extends through the layer of the sound-absorbing material to permit the opposite, open end of the inner tube to communicate acoustically with the inner chamber.

According to a second aspect of the present invention, a method is provided for simulating spatial sound. According to a preferred embodiment, the method comprises the step of providing a headset having left and right headphones interconnected by a headband, with each of the headphones having a hollow casing forming an interior chamber having an opening effective for receiving a listener's ear. The method further comprises the steps of mounting first and second pluralities of electroacoustic transducers to the casing of the left and right headphones, respectively, and electrically connecting a sound source to each of the electroacoustic transducers. The first and second pluralities of electroacoustic transducers are used to reproduce sound in response to electric signals for the sound source. The method further includes the step of focusing the sound reproduced by each one of the first and second pluralities of electroacoustic transducers and directing the sound toward the pinna of the corresponding ear of the listener to simulate spatial or 3-dimensional sound as perceived by the listener.

In other embodiments, the step of mounting may comprise the steps of disposing each one of the first and second pluralities of electroacoustic transducers within a hollow, outer tube and attaching each of the hollow, outer tubes to the casing of one of the left and right headphones.

In one embodiment, the step of focusing may comprise the step of coaxially disposing a hollow, inner tube within each one of the hollow, outer tubes so that a first open end of each of the inner tubes faces the corresponding one of the electroacoustic transducers and a second end is in acoustic communication with the interior chamber of the corresponding headphone casing. The step of focusing may further include the step of surrounding a longitudinally extending portion of each of the inner tubes with a sound-absorbing material disposed within the corresponding one of the outer tubes.

In a preferred embodiment, the left and right headphones each include thirteen of the sound focusing assemblies mounted on the corresponding casing. Alternatively, each headphone may include as few as five, and as many as twenty five, of the sound focusing assemblies provided they are properly arranged on the headphone casing to permit the reproduction of simulated spatial sound over the hemisphere of each of the casings.

BRIEF DESCRIPTION OF THE DRAWINGS

The foregoing and other aspects of the present invention will become more apparent from the subsequent detailed description of the invention when considered in conjunction with the accompanying drawings, wherein.

DETAILED DESCRIPTION

Figure 1:
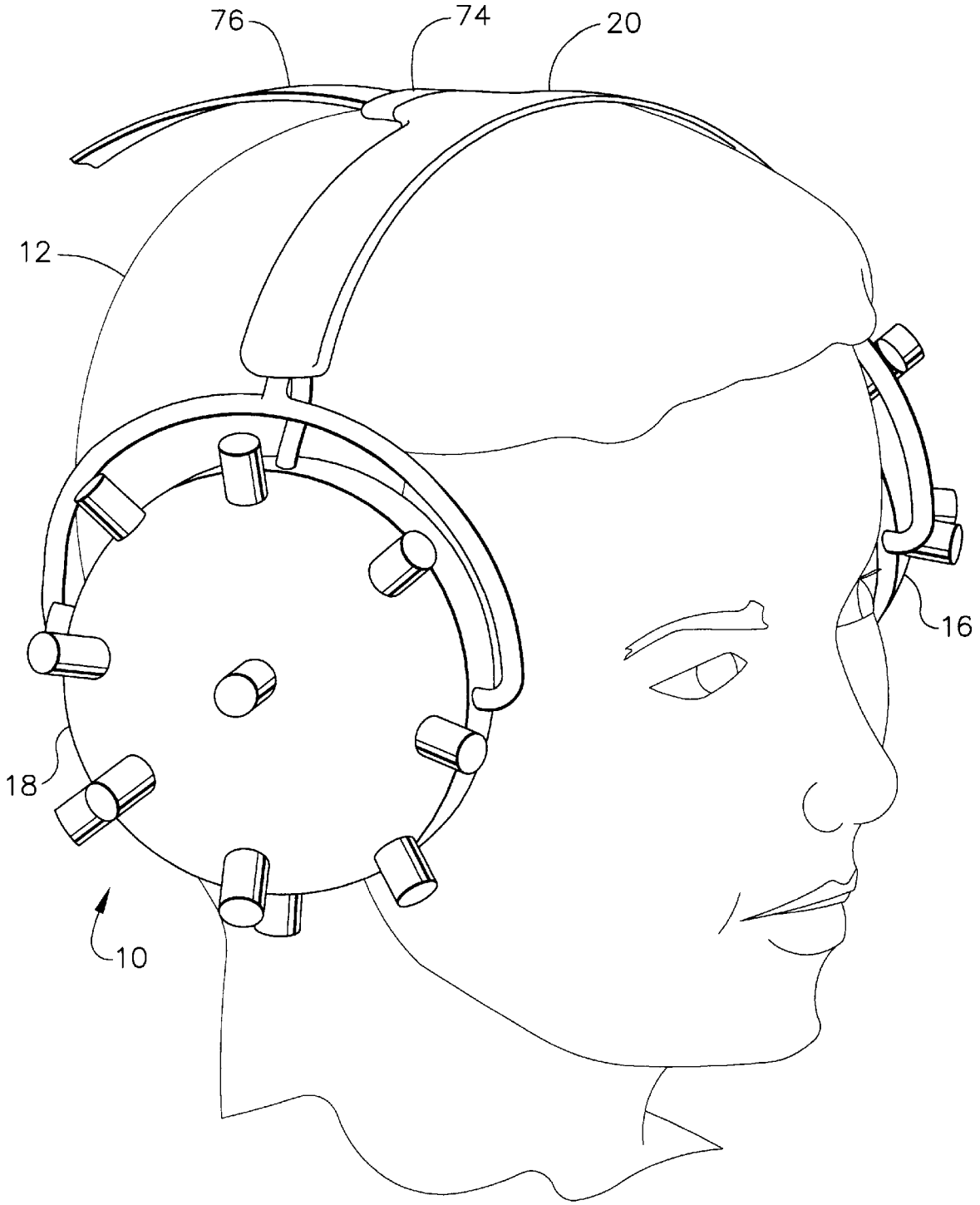
FIG. 1 is a perspective view illustrating a virtual sound headset according to the present invention as installed on the head of a person using the headset.
Figure 2:
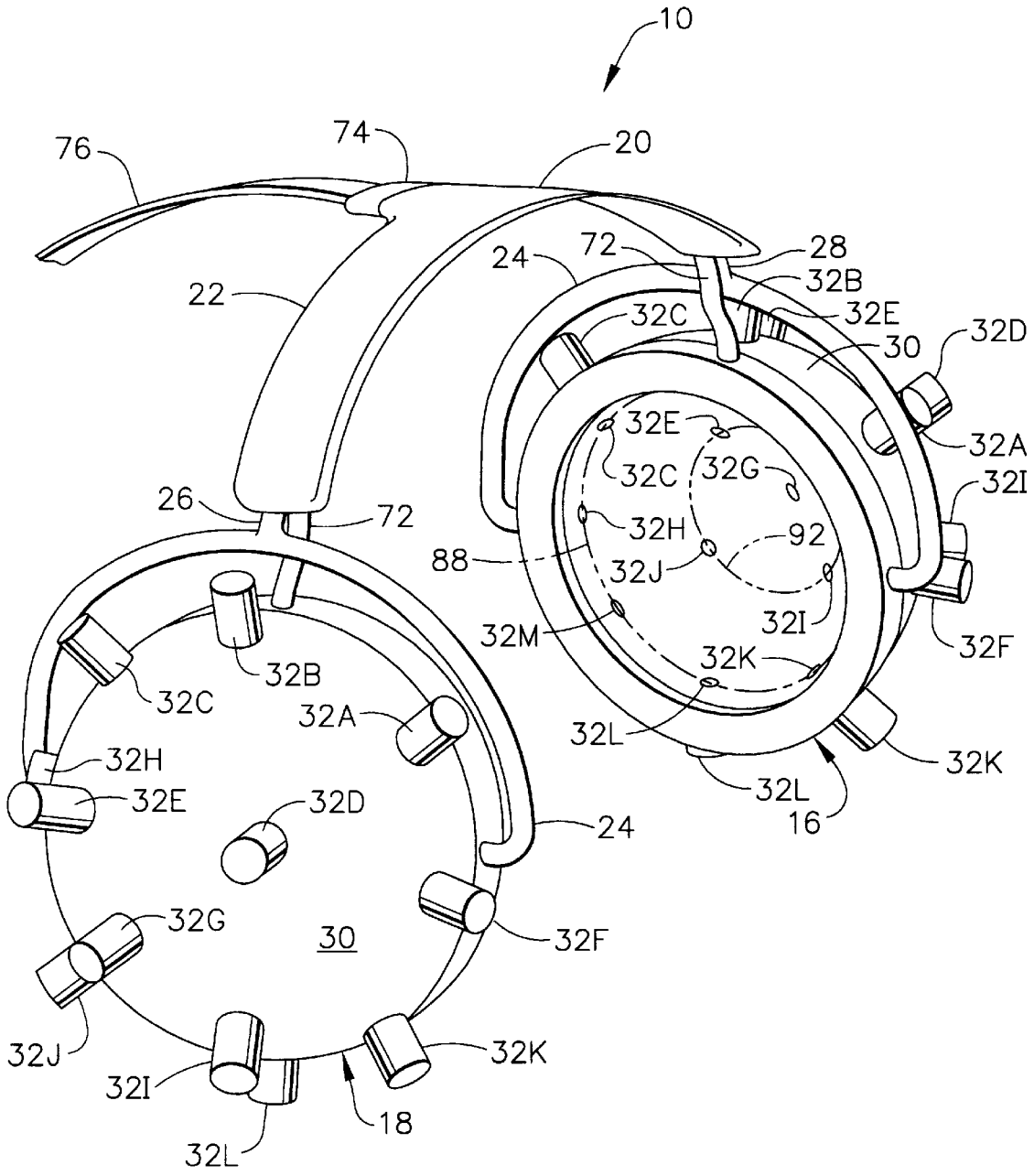
FIG. 2 is a perspective view further illustrating the virtual sound headset shown in FIG. 1.

Referring now to the drawings, FIG. 1 is a perspective view illustrating a virtual sound headset 10 according to the present invention, as positioned on the head of a listener, or user 12. FIG. 2 is a perspective view of headset 10 only, further illustrating headset 10. Headset 10 is used to reproduce sound and deliver the sound to the ears of listener 12 in a novel manner that causes the sound to have a three-dimensional, or spatial quality as perceived by the listener 12 by focusing the sound and directing the sound toward the pinna of each ear of the listener 12 from a variety of spherical positions relative to the head of listener 12 to allow natural spectral modification of the sound to occur. As shown schematically in FIG. 3 and discussed subsequently in greater detail, headset 10 may be used as part of a virtual reality system 14. Headset 10 includes a left headphone 16 and a right headphone 18 which are disposed in surrounding relationship with the left and right ears, respectively of listener 12 when headset 10 is in use. Headset 10 further includes a headband 20 interconnecting the left 16 and right 18 headphones. Headband 20 has a central portion 22 engaging the upper portion of the head of listener 12, when headset 10 is in use, and further includes a pair of generally arcuate headphone support frames 24. Each of the frames 24 is attached to one of the opposite ends 26 and 28 of central portion 22 and to the corresponding one of the headphones 16 and 18.

Each of the headphones 16 and 18 includes a hollow casing 30 and a plurality of sound focusing assemblies 32 mounted on casing 30. Although various aspects and advantages of the present invention will be illustrated in conjunction with the left headphone 16, and more particularly with respect to the structural features and functions of casing 30 and the sound focusing assemblies 32 of headphone 16, it should be understood that these aspects and advantages of the present invention are equally applicable to the right headphone 18.

Figure 4:
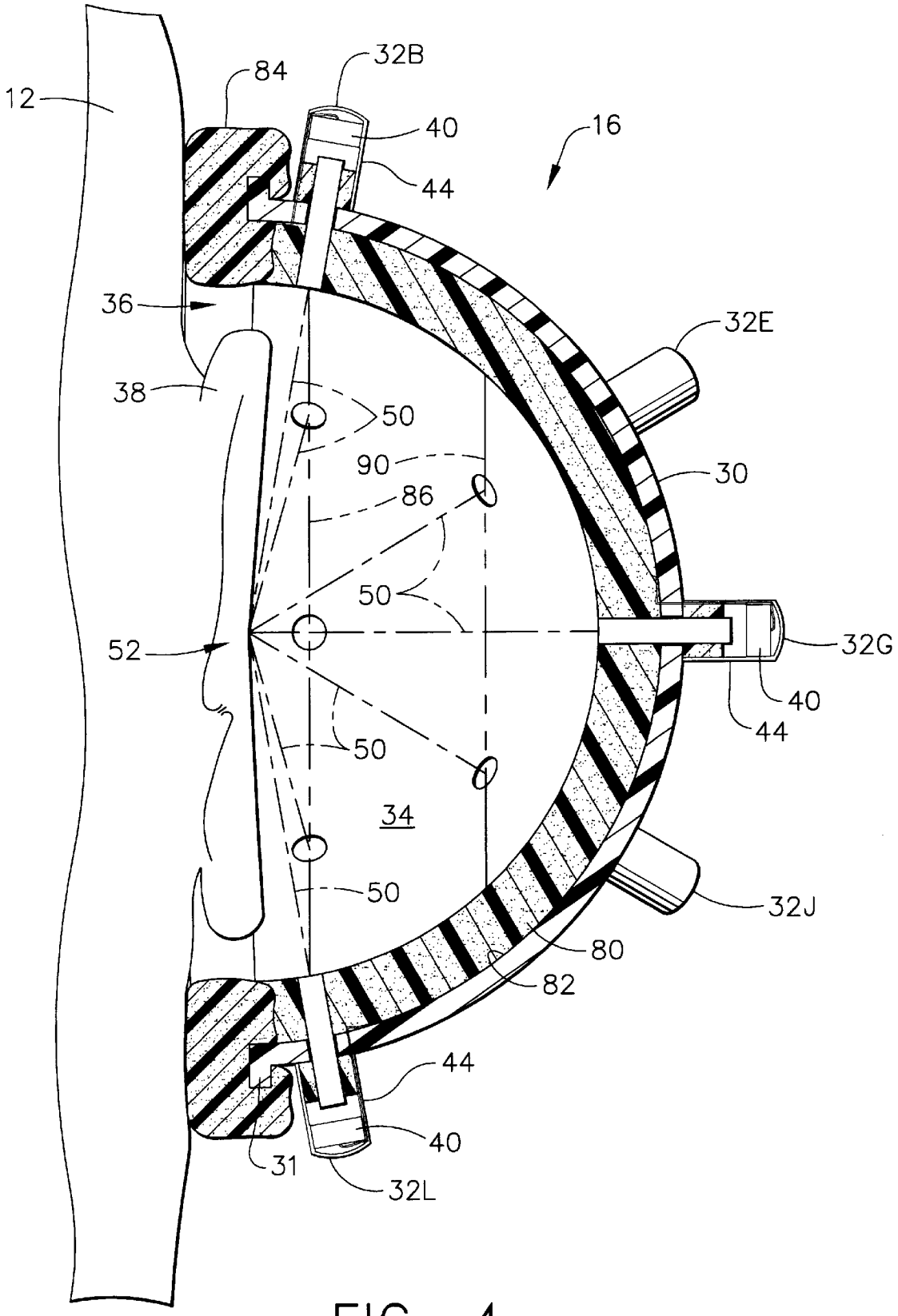
FIG. 4 is a cross-sectional view illustrating one of the headphones of the virtual sound headset of the present invention.

Casing 30 preferably has a substantially hemispherical shape and forms an interior chamber 34 having an opening 36 effective for receiving one of the ears of listener 12, for instance the left ear 38 of listener 12 as shown in FIG. 4, so that each of the ears of listener 12 is disposed within one of the interior chambers 34 when headset 10 is in use. Each of the headphones 16 and 18 further includes a radially extending, annular flange 31 attached to casing 30 at a location proximate opening 36. Each flange 31 and the corresponding casing 30 are preferably made as a unitary construction and are preferably made of a molded plastic material. Each flange 31 is effective for receiving an annular seal as subsequently discussed.

Figure 5:
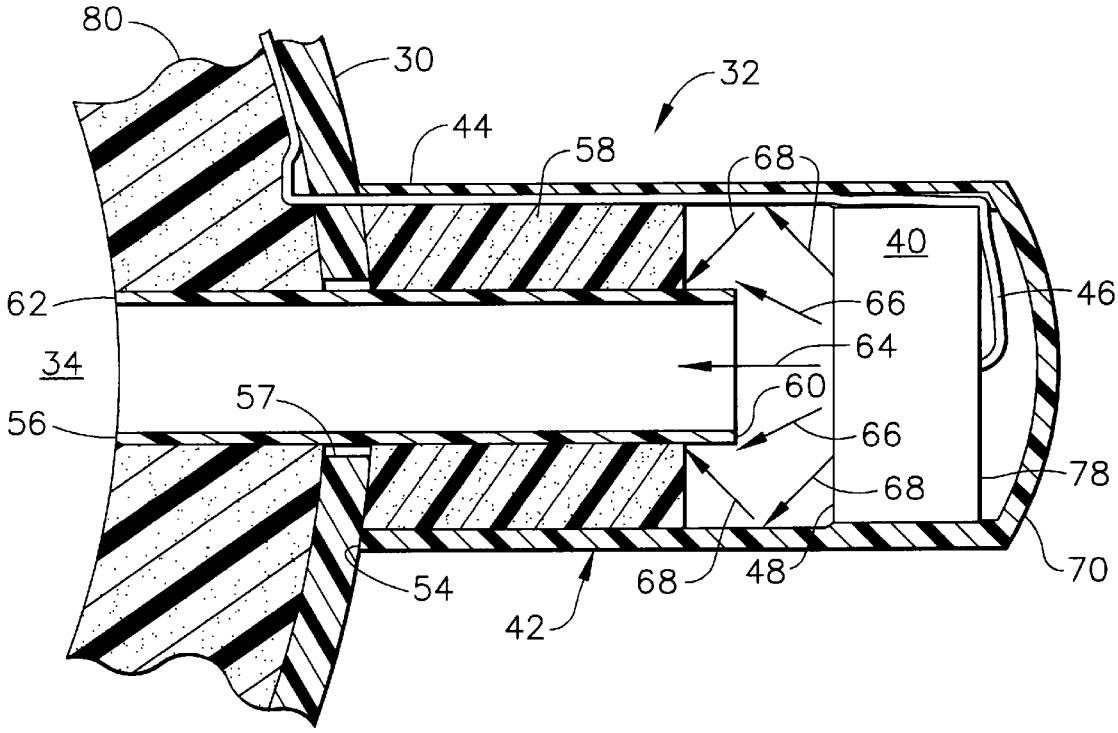
FIG. 5 is an enlarged cross-sectional view of a portion of the headphone illustrated in FIG. 3.
Figure 6:
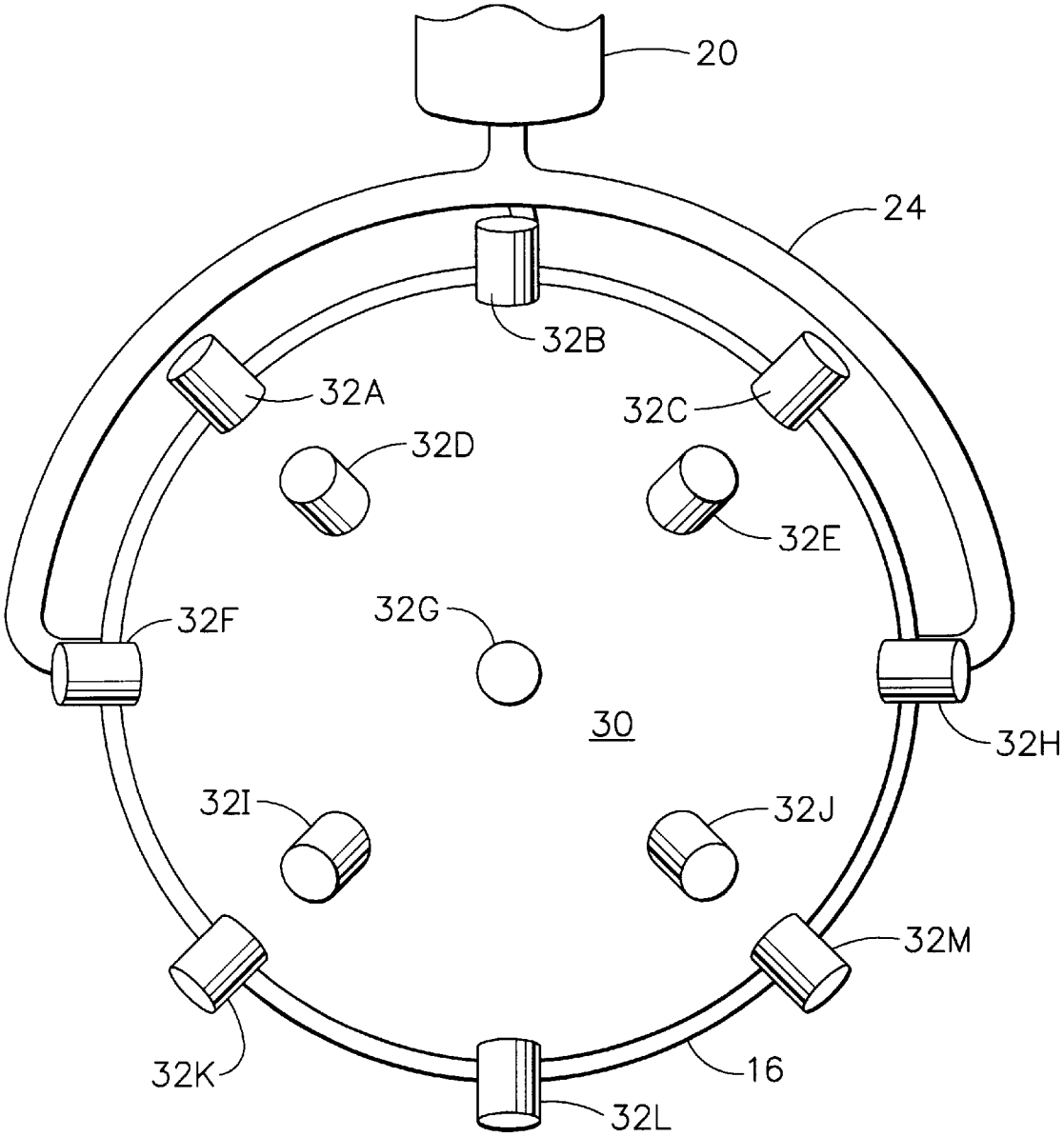
FIG. 6 is a side elevational view of one of the headphones embodying the principles of the present invention, illustrating the included array of sound focusing assemblies.

As best seen in FIGS. 1, 2, and 6, each of the sound focusing assemblies 32 are spaced apart from one another on casing 30 and, as shown in FIGS. 2, 4 and 5, are in acoustic communication with the corresponding interior chamber 34. Each sound focusing assembly 32 includes an electroacoustic transducer 40 which is effective for reproducing sound in response to an electric input signal. Transducers 40 preferably comprise miniaturized hi-fidelity speakers. The sound focusing assemblies 32 protrude radially outward from casing 30. Each sound focusing assembly 32 further includes a mechanical-acoustic means, indicated at 42 in FIG. 5, for mounting the electroacoustic transducer 40 to casing 30 and for directionalizing or focusing the sound emanating from transducer 40 to permit the listener 12 to identify the directional orientation of the sound.

The mechanical-acoustic means 42 includes an outer tube 44, having an inner diameter sized to permit the transducer 40 to be disposed within tube 44 as best seen in FIG. 5. Transducer 40 receives electric signals from a sound producing device via wire 46, and includes a sound-emitting surface 48 which is preferably substantially planar. Each of the outer tubes 44 is substantially symmetrically disposed about a longitudinal centerline axis 50 of the corresponding sound focusing assembly 32. Each of the axes 50 preferably comprises a radial line which intersects a substantially central, outer portion 52 of ear 38 which comprises a substantially central portion of the pinna of ear 38 as shown in FIG. 4. Each tube 44 is preferably made of a relatively hard material such as plastic, preferably polyvinyl chloride, and includes an inner end 54 which is attached to an outer surface of the hollow casing 30.

The mechanical-acoustic means 42 for mounting the electroacoustic transducer 40 on casing 30 and for directionalizing or focusing the sound emanating from transducer 40 further includes a hollow inner tube 56 and a sound absorbing material 58. The inner tube 56 is coaxially disposed with, and radially inward of, the outer tube 44 and includes a first, open end 60 disposed within outer tube 44. End 60 of inner tube 56 faces and is longitudinally spaced apart from the sound-emitting surface 48 of transducer 40.

The inner tube 56 extends longitudinally within a portion of the outer tube 44, through end 54 of outer tube 44, and then through an aperture 57 formed in casing 30 as shown in FIG. 5. The inner tube 56 is preferably positioned within aperture 57 so that tube 56 does not contact casing 30 in order to acoustically isolate tube 56 from casing 30 by preventing any mechanical vibrations present in casing 30 from being transmitted to tube 56. The inner tube 56 includes an opposite, open end 62 which is in acoustic communication with the interior chamber 34. As mentioned previously, the inner diameter of the outer tube 44 is selected to accommodate the size of the particular transducer 40 being used, and therefore the inner diameter of tube 44 may vary in magnitude with application. The inner diameter of the inner tube 56, as well as the ratio between inner diameters of the inner tube 56 and the outer tube 44, may also vary with application. However, in one preferred embodiment, the inner diameter of the inner tube 56 ranges from about 3/16 inch to about 1/4 inch which the inventor has observed to produce effective results with regard to focusing the sound emanating from transducer 40. The sound-absorbing material 58 is disposed within the outer tube 44 and surrounds a longitudinally extending portion of the inner tube 56 and supports tube 56 in the desired position, i.e., coaxially disposed with outer tube 44 about axis 50 of sound focusing assembly 32. As shown in FIG. 4, the sound-absorbing material 58 is longitudinally spaced apart from end 60 of inner tube 56 and from the sound emitting surface 48 of transducer 40. The sound-absorbing material 58 is effective for substantially closing end 54 of the outer tube 44 and may comprise any conventional sound-absorbing material such as a sound-absorbing foam for instance.

The inner tube 56 is preferably made of a relatively hard material such as plastic, comprising polyvinyl chloride in a preferred embodiment, which is highly effective for transmitting sound within tube 56, i.e., the material of tube 56 offers a relatively low resistance to the transmission of sound there within. The open end 60 of the inner tube 56 receives sound which is substantially parallel to the longitudinal centerline axis 50 of sound focusing assembly 32, such as that indicated schematically by sound line 64, and for transmitting this sound in a substantially radial direction to the interior chamber 34 and to the pinna of ear 38 of listener 12. In contrast, sound emanating from transducer 40 in many other directions, i.e., those directions not substantially parallel to centerline 50, may propagate directly to the sound-absorbing material 58, as indicated by sound lines 66, or may first reflect off of the inner surface of the outer tube 44 and then into the sound-absorbing material 58 as indicated by sound lines 68. In either event, this sound is substantially absorbed by the sound-absorbing material 58 and does not propagate inward to the interior chamber 34 and the ear 38 of listener 12. Accordingly, the sound transmitted by each of the sound focusing assemblies 32 to listener 12 is highly focused or directionalized so that the spatial quality of the sound, with respect to directional orientation of the sound as perceived by the listener 12, is simulated. The perceived distance, from listener 12, of the source of the sound emanating from any of the sound focusing assemblies 32 may be simulated by varying the intensity of sound reproduced by the corresponding assembly 32. Although the particular mechanism is not entirely understood, the inventor has determined that the perceived distance of the sound emanating from transducer 40 is also affected by the size of the inner diameter of inner tube 56. For instance, as the inner diameter of inner tube 56 is reduced, the sound appears to be farther away, as perceived by the listener 12.

As shown in FIG. 5, the electroacoustic transducer 40 is disposed within the outer tube 44, proximate a second, opposite end 70 of the outer tube 44. In the illustrative embodiment, end 70 is closed and the wire 46 providing an electric signal to transducer 40 is routed from transducer 40 toward end 54 of the outer tube 44, along the inner surface of tube 44. The wire 46 then passes through casing 30 and is routed circumferentially along an inner surface 82 of the hollow casing 30. The wires 46 from each of the transducers 40 of the left headphone 16 may be bundled together in a cable or electrical conduit 72 disposed exterior of headphone 16. The wires 46 connected to the transducers 40 of the right headphone 18 may be similarly routed and bundled together in a second electrical cable 72 disposed exterior of headphone 18. Each cable 72 may generally follow the contour of the central portion 22 of headband 20 and terminates in a single multi-pin connector 74 of an electrical cable or conduit 76 as shown in FIG. 1.

Alternatively, ends 70 of the outer tube 44 may be open so that a surface 78 of transducer 40 which is opposite the sound-emitting surface 48 is exposed. In this alternate embodiment, each wire 46 may be routed outward through the open end 70 of the outer tube 44 and terminated in a suitable electrical connector. Furthermore, in this embodiment the transducer 40 may protrude partially, in a longitudinal direction, through end 70 outward of tube 44. Whether end 70 is open or closed may vary with application, depending upon the particular manufacturing method of installing transducers 40 and assembling them within tube 44. However, the particular configuration of end 70 does not affect the operation of the sound focusing assemblies 32 of the present invention.

As shown in FIG. 4 with respect to the left headphone 16, each of the headphones 16 and 18 includes a layer of a sound-absorbing material 80 disposed within and attached to an inner surface 82 of the hollow casing 30, and conforming generally to the shape of casing 30. Sound-absorbing material 80 may be the same as the conventional sound-absorbing material 58. The inner tube 56 of each sound focusing assembly 32 extends through the layer of the sound-absorbing material 80 so that end 62 of tube 56 communicates acoustically with the interior chamber 34. Each of the headphones 16 and 18 further includes an annular seal 84 which is attached to the radially extending, annular flange 31 of the corresponding casing 30. Seals 84 are made of a relatively soft, resilient material and are disposed in surrounding relationship with the corresponding ear of listener 12 and in sealing engagement with the head of listener 12 when headset 10 is in use.

The sound focusing assemblies 32 are arranged, or arrayed on casing 30 in a configuration which permits the reproduction of sound which simulates spatial, three-dimensional sound over the hemispheres corresponding to the left 16 and right 18 headphones. In a preferred embodiment, each of the headphones 16 and 18 includes thirteen of the sound focusing assemblies 32. The preferred arrangement of these thirteen sound focusing assemblies, designated as 32A–32M, is illustrated in FIG. 6 which is a side elevation view of the left headphone 16, and in FIG. 2 which is a perspective view of headset 10. The following discussion concerning the positioning of the sound focusing assemblies 32 is equally applicable to headphones 16 and 18. In the illustrative embodiment, sound focusing assembly 32G is mounted on casing 30 at the apex of the hemispherically-shaped casing 30. The approximate location of the remaining sound focusing assemblies 32 may be determined as follows: the sound focusing assemblies 32A, 32B, 32C, 32F, 32H, 32K, 32L, and 32M are mounted on casing 30 so that a first vertical plane 86 intersects the centerline axis 50 of each of these sound focusing assemblies 32 at the end 62 of the inner tube 56, with these points of intersection disposed about a circle 88 (shown in FIG. 2) existing in plane 86. As shown in FIG. 4, plane 86 of the left headphone 16 is in close proximity to the outer ear 38 of listener 12. Sound focusing assemblies 32D, 32E, 32I, and 32J are mounted on casing 30 so that a second vertical plane 90, which is disposed intermediate plane 86 and sound focusing assembly 32G, intersects the centerline axis 50 of each of these sound focusing assemblies 32 at the end 62 of inner tube 56, with these points of intersection being disposed about a circle 92 (shown in FIG. 2) which exists in plane 90. It should be understood that sound focusing assemblies 32 need not be precisely located as just described, but rather that some deviation from these positions may exist provided that the sound reproduced by assemblies 32 effectively simulates spatial, three-dimensional sound as perceived by the listener 12.

The sound focusing assemblies 32A–32M reproduce and transmit sounds in a manner which listener 12 perceives as emanating from the following directions: assembly 32B, from a position above listener 12; assembly 32L, from a position below listener 12; assembly 32F, from a position forward of listener 12; assembly 32H, from a position behind listener 12; assembly 32G, from a position to the side (either left or right) of listener 12; assembly 32A from a position forward and above listener 12; assembly 32C, from a position above and behind listener 12; assembly 32M, from a position behind and below listener 12; assembly 32K, from a position forward and below listener 12; and the remaining assemblies, i.e., 32D, 32E, 32I and 32J, from intermediate directions as illustrated in FIGS. 2 and 6.

In alternative embodiments (not shown) each of the headphones 16 and 18 may include 5, 17, 23 or 25 of the sound focusing assemblies 32. The inventor has determined that the use of less than five of the assemblies 32 would not permit an effective simulation of spatial sound, while the use of more than twenty five of the assemblies 32 would provide limited advantage and is therefore not required to effectively simulate spatial sound. In the alternate embodiment having five of the sound focusing assemblies 32 mounted on the casing 30 of each of the headphones 16 and 18, the sound-focusing assemblies 32 are preferably positioned at the locations denoted by assemblies 32B, 32F, 32G, 32H, and 32L. In the remaining alternative embodiments, the additional sound focusing assemblies 32, relative to those shown in FIGS. 2 and 6, are mounted on casings 30 at positions intermediate selected pairs of the sound focusing assemblies 32 shown in FIGS. 2 and 6. The use of additional sound focusing assemblies, relative to those employed in the embodiment having five of the assemblies 32, are provided for the purpose of providing a smooth transition of spatial sound as perceived by listener 12.

In operation, the virtual sound headset 10 of the present invention provides a simple and economical means for simulating three-dimensional, spatial sound as perceived by the user. This simulation of spatial sound is accomplished by mounting a plurality of the transducers 40 at different spherical positions relative to the head of the listener 12 and focusing or directionalizing the sound emanating from each transducer 40 so the sound is directed toward the pinna of the corresponding ear of the listener 12. The inventor believes that spatial sound is simulated by the various angles of incidence of the sound which is delivered to each pinna combined with a natural spectral modification of the sound which occurs due to the interaction of the sound with the corresponding pinna. The simulation of spatial sound which is accomplished by utilizing the principles of the present invention is achieved without the need for artificially modifying the sound with head-related transfer functions (HRTFs) which are utilized in some devices known in the art.

Figure 3:
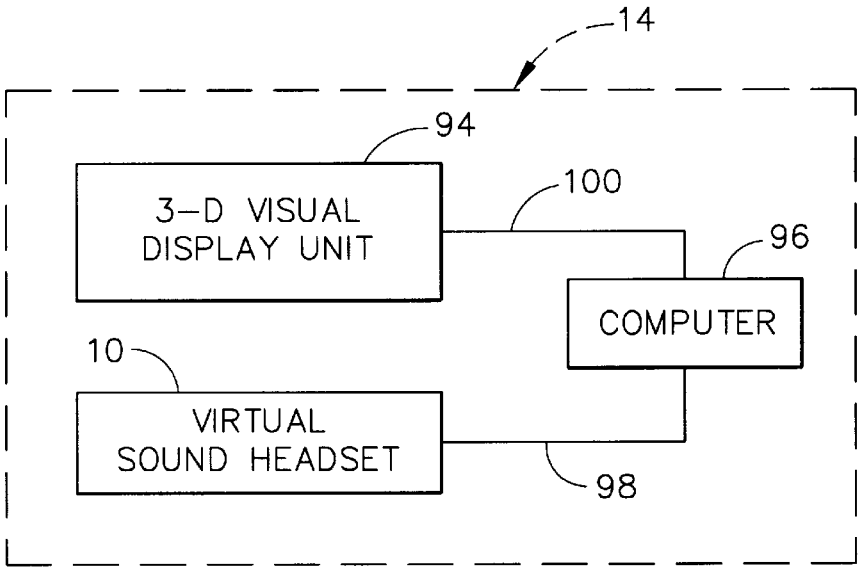
FIG. 3 is a block diagram illustrating a virtual reality system which may incorporate the virtual sound headset of the present invention.

As stated previously, the virtual sound headset 10 of the present invention may be included in the virtual reality system 14 depicted schematically in FIG. 3. However, the following discussion regarding the application of headset 10 in the virtual reality system 14 is shown by way of illustration, and not of limitation, since the virtual sound headset 10 of the present invention may be used in a wide variety of applications to reproduce sound which simulates three-dimensional, spatial sound as perceived by the user of headset 10. In additional to virtual sound headset 10, the virtual reality system 14 includes a 3-D visual display unit 94 and a computer 96 comprising a programmable source of sound which is electrically connected to headset 10 and display unit 94 by conventional electric circuitry indicated schematically at 98 and 100, respectively. The circuitry indicated at 98 interfaces with cable 76 of headset 10. During operation of virtual reality system 14, the computer 96 may cause the electroacoustic transducers 40 of the left 16 and right 18 headphones to emit sound waves according to a preselected or predetermined program. Alternatively, the computer 96 may cause the electroacoustic transducers 40 of the left 16 and right 18 headphones to emit sound waves according to an interactive program. For instance, the sound program may provide life-like sounds to accompany a virtual reality game, with the visual output of the game provided by the 3-D visual display unit 94. A moving sound may be simulated with respect to either one of the ears of listener 12 by causing sound to be emitted from a combination of the transducers 40 of the sound focusing assemblies 32, according to events determined by interaction of the listener with the virtual reality game. This may be accomplished by the incorporation of a sound card (not shown) in computer 80. In one preferred embodiment, with each of the headphones 16 and 18 including thirteen of the sound focusing assemblies 32 positioned as described previously, the sound card may have twenty six pre-programmed assignments for the transducers 40 of the sound focusing assemblies 32 with each of the assignments corresponding to the spatial positioning of one of the transducers 40 relative to the head of listener 12. In this case the sound card may be programmed to include the desired volume of each selected transducer 40 and the desired time between the selection of various transducers 40 to achieve time-of-arrival differences with respect to the sound emitted from the particular transducers 40. For instance, the sound card may be programmed so that the transducers 40 which are similarly positioned in the headphones 16 and 18, may be activated at somewhat different times.

Additionally, a mixing apparatus (not shown) such as a mixing board of the type commonly used in sound studios, could be used in lieu of computer 96 and connected to the virtual sound headset 10 in a manner permitting control of the input signals to transducers 40 in response to the operator of the mixing apparatus. It is envisioned that this could be accomplished by the use of a joystick connected to the mixing apparatus. As a further alternative, it is also envisioned that a plurality of headsets 10 could be electrically coupled to a computer, or other programmable mixing apparatus for certain applications. For instance, a school teacher could use a system of this type for instructional use to a group of children. Other applications of headset 10 include use in movie theaters, simulators, amusement park attractions, and plays.

While the foregoing description has set forth the preferred embodiments of the present invention in particular detail, it must be understood that numerous modifications, substitutions and changes can be undertaken without departing from the true spirit and scope of the present invention as defined by the ensuing claims. For instance, alternate means may be provided in lieu of the inner tubes 56 and sound absorbing material 58, for focusing the sound emanating from each of the electroacoustic transducers 40 in conjunction with the outer tubes 44. For example, each inner tube 56 and the associated sound absorbing material 58, may be replaced by a fixed or variable aperture formed in the corresponding casing 30 at a position which is aligned with the centerline 50 of the corresponding sound focusing assembly 32. These and other alternatives may be utilized provided that the principles of the present invention are maintained with respect to focusing sound and directing the sound toward the pinna of each ear of the listener to simulate spatial or three-dimensional sound as perceived by the listener. The invention is therefore not limited to specific preferred embodiments as described, but is only limited as defined by the following claims.

What is claimed is:

1. A virtual sound headset comprising:

a left headphone and a right headphone, said headphones being disposed in surrounding relationship with the corresponding ear of a listener for providing sounds to the listener when said headset is in use;

a headband interconnecting said left and right headphones, said headband having a central portion engaging the upper portion of the listener's head when said headset is in use;

said left and right headphones each including:

a hollow casing forming an interior chamber having an opening effective for receiving one of the listener's ears so that each of the listener's ears is disposed within one of said interior chambers when said headset is in use;

a plurality of sound focusing assemblies mounted on said casing, said sound focusing assemblies being spaced apart from one another on said casing and being in acoustic communication with said interior chamber;

each said sound focusing assembly comprising:

an electroacoustic transducer effective for reproducing sound in response to an electric input signal;

a mechanical-acoustic means for mounting said electroacoustic transducer on said casing and for focusing the sound emanating from said transducer so as to simulate the directional orientation of the sound as perceived by the listener.

2. The virtual sound headset as recited in claim 1, wherein said mechanical-acoustic means for mounting said electroacoustic transducer and for directionalizing sound emanating from said transducer comprises:

a tube having an inner diameter sized to permit said transducer to be disposed within said tube, said tube having a first end attached to said casing; and means for transmitting sound emanating from said transducer to said interior chamber in a direction substantially parallel to a longitudinal centerline axis of said sound focusing assembly and for absorbing sound emanating from said transducer in other directions;

said transducer being disposed within said tube proximate an opposite end of said tube, said transducer having a sound-emitting surface facing and spaced apart from said transmitting and absorbing means.

3. The virtual sound headset as recited in claim 2, wherein:

said tube comprises an outer tube;

said transmitting and absorbing means comprises an inner tube coaxially disposed with and radially inward of said outer tube and a sound-absorbing material disposed within said outer tube and surrounding a longitudinally extending portion of said inner tube;

said inner tube has a first, open end facing and longitudinally spaced apart from the sound-emitting surface of said transducer and disposed within said outer tube, said inner tube extending longitudinally within a portion of said outer tube and through said first, open end of said outer tube, said inner tube further including an opposite, open end in acoustic communication with said interior chamber;

said inner tube being effective for transmitting sound emanating from said transducer to the corresponding ear of the listener in a direction substantially parallel to the longitudinal centerline axis of said sound focusing assembly.

4. The virtual sound headset as recited in claim 3, wherein:

each of said casings has a substantially hemispherical shape;

said longitudinal centerline of each of said sound focusing assemblies comprises a radial line intersecting a substantially central, outer portion of the corresponding ear of the listener.

5. The virtual sound headset as recited in claim 3, wherein each of said headphones further comprises:

a layer of a second sound-absorbing material disposed within and attached to an inner surface of said casing and conforming generally to the shape of said casing; wherein said inner tube extends through said layer of said second sound-absorbing material to permit said opposite, open end of said inner tube to communicate acoustically with said interior chamber.

6. The virtual sound headset as recited in claim 3, wherein:

said inner tube is made of polyvinyl chloride.

7. The virtual sound headset as recited in claim 6, wherein:

said outer tube is made of polyvinyl chloride.

8. The virtual sound headset as recited in claim 1, wherein each of said headphones further comprises:

an annular flange attached to said casing;

an annular seal attached to said annular flange, said seal being disposed in surrounding relationship with the corresponding ear of the listener and in sealing engagement with the listener's head when said headset is in use.

9. The virtual sound headset as recited in claim 1, wherein:

the number of said plurality of sound focusing assemblies mounted on said casing of said left headphone is greater than 2;

the number of said plurality of sound focusing assemblies mounted on said casing of said right headphone is greater than 2.

10. The virtual sound headset as recited in claim 1, wherein:

the number of said plurality of sound focusing assemblies mounted on said casing of said left headphone is at least 5;

the number of said plurality of sound focusing assemblies mounted on said casing of said right headphone is at least 5.

11. The virtual sound headset as recited in claim 1, wherein:

the number of said plurality of sound focusing assemblies mounted to said casing of said left headphone is 13;

the number of said plurality of sound focusing assemblies mounted to said casing of said right headphone is 13.

12. The virtual sound headset as recited in claim 11, wherein:

each of said casings has a substantially hemispherical shape;

said sound focusing assemblies are mounted on said casings so that the sound reproduced by each of said transducers is transmitted in a substantially radial direction intersecting a substantially central, outer portion of one of the listener's ears, said substantially radial directions of said plurality of sound focusing assemblies being different from one another.

13. The virtual sound headset as recited in claim 1, wherein:

said headband further includes a pair of generally arcuate headphone support frames, each said frame being attached to opposite ends of said central portion of said headband and to one of said left and right headphones.

14. A virtual sound headset comprising:

a left headphone and a right headphone, said headphones being disposed in surrounding relationship with the corresponding ear of a listener for providing sound to the listener when said headset is in use;

a headband interconnecting said left and right headphones, said headband having a central portion engaging the upper portion of the listener's head when said headset is in use;

said left and right headphones including:

a hollow casing forming an interior chamber having an opening effective for receiving one of the listener's ears so that each of the listener's ears is disposed within one of said interior chambers when said headset is in use; and a plurality of sound focusing assemblies mounted on said casing, said sound focusing assemblies being spaced apart from one another on said casing and being in acoustic communication with said interior chamber;

each of said sound focusing assemblies comprising:

an electroacoustic transducer effective for reproducing sound in response to an electrical input signal;

an outer tube having an inner diameter sized to permit said transducer to be disposed within said outer tube, said outer tube having a first end attached to said casing;

an inner tube coaxially disposed with and radially inward of said outer tube; and a sound-absorbing material disposed within said outer tube and surrounding a longitudinally extending portion of said inner tube;

said inner tube having a first, open end facing and spaced apart from a sound-emitting surface of said transducer and disposed within said outer tube, said inner tube extending longitudinally within a portion of said outer tube and through said first end of said outer tube, said inner tube further including an opposite, open end in acoustic communication with said interior chamber;

said inner tube being effective for transmitting sound emanating from said transducer to the corresponding ear of the listener in a substantially radial direction.

15. A method for simulating spatial sound comprising the steps of:

providing a headset having left and right headphones interconnected by a headband, each of the headphones having a hollow casing forming an interior chamber having an opening effective for receiving a listener's ear;

mounting first and second pluralities of electroacoustic transducers to the casings of the left and right headphones, respectively;

electrically connecting a sound source to each of the electroacoustic transducers of the first and second pluralities of the electroacoustic transducers;

using the first and second pluralities of electroacoustic transducers to reproduce sound in response to electric signals from the sound source;

focusing the sound produced by each one of the first and second pluralities of electroacoustic transducers and directing the sound toward the pinna of the corresponding ear of the listener to simulate spatial or three-dimensional sound as perceived by the listener.

16. The method as recited in claim 15, wherein said step of mounting comprises the steps of:

disposing each one of the first and second pluralities of electroacoustic transducers within a hollow, outer tube;

attaching each of the hollow, outer tubes to the casing of one of the left and right headphones.

17. The method as recited in claim 16, wherein said step of focusing comprises the steps of:

coaxially disposing a hollow, inner tube within each one of the hollow, outer tubes with a first open end of each inner tube facing the corresponding one of the first and second pluralities of electroacoustic transducers and a second end of each of the inner tubes in acoustic communication with the interior chamber formed by the hollow casing of one of the left and right headphones;

surrounding a longitudinally extending portion of each of the inner tubes with a sound-absorbing material disposed within the corresponding one of the outer tubes.

* * * * *